US009145672B1

(12) United States Patent
Broughton

(10) Patent No.: US 9,145,672 B1
(45) Date of Patent: Sep. 29, 2015

(54) APPARATUS AND METHOD FOR ATTACHING DECK TO STRUCTURE

(71) Applicant: Lance Broughton, Wentzville, MO (US)

(72) Inventor: Lance Broughton, Wentzville, MO (US)

( * ) Notice: Subject to any disclaimer, the term of this patent is extended or adjusted under 35 U.S.C. 154(b) by 9 days.

(21) Appl. No.: 14/456,513

(22) Filed: Aug. 11, 2014

(51) Int. Cl.

| | |
|---|---|
| ***E04H 12/00*** | (2006.01) |
| ***E04B 1/19*** | (2006.01) |
| ***E04B 1/38*** | (2006.01) |
| ***E04C 3/02*** | (2006.01) |

(52) U.S. Cl.
CPC ..... *E04B 1/1903* (2013.01); *E04B 1/38* (2013.01); *E04C 3/02* (2013.01)

(58) Field of Classification Search
CPC ..... E04B 1/003; E04B 1/0038; E04B 1/38; E04B 1/40; E04B 1/2604; E04B 1/2612; E04B 2001/405; E04B 2001/2415; E04B 2001/2644; E04B 1/1903; E04C 3/02
USPC ..... 52/289, 655.1, 698, 704, 712, 713, 52/745.21; 403/258–260, 231, 247
See application file for complete search history.

(56) References Cited

U.S. PATENT DOCUMENTS

| | | | | |
|---|---|---|---|---|
| 4,114,328 | A | 9/1978 | Lawrence | |
| 4,811,542 | A * | 3/1989 | Jewell | 52/745.21 |
| 5,201,156 | A * | 4/1993 | Newman | 52/299 |
| 5,242,239 | A * | 9/1993 | Hosokawa | 403/258 |
| 6,397,552 | B1 | 6/2002 | Bourque | |
| 6,427,391 | B1 * | 8/2002 | Lyons | 52/73 |
| 2005/0160683 | A1 * | 7/2005 | Eldeen | 52/73 |
| 2005/0284056 | A1 * | 12/2005 | Ghiringhelli | 52/289 |
| 2008/0302037 | A1 * | 12/2008 | Brown et al. | 52/289 |
| 2012/0315081 | A1 * | 12/2012 | Bouldin et al. | 403/205 |
| 2013/0298494 | A1 * | 11/2013 | Corsi | 52/705 |
| 2014/0013701 | A1 * | 1/2014 | Rodgers | 52/698 |
| 2014/0215956 | A1 * | 8/2014 | Smith et al. | 52/705 |

OTHER PUBLICATIONS

Schneider, III; "Lateral Support of Residential Deck Structures, a Primer;" Mar. 1, 2011.
"A deck lateral load connection to meet IRC® 2009/2012;" *Deck Harness™*; Jan. 2014; GRK Fasteners.
"Deck Lateral Load Connections to Meet the 2009/2012 IRC for Multiple Conditions;" *Technical Bulletin*; May 2011; pp. 1-2; Simpson Strong-Tie Company Inc.
Dec. 2, 2014 Office Action issued in U.S. Appl. No. 14/270,090.
Feb. 20, 2015 Office Action issued in U.S. Appl. No. 14/270,090.

* cited by examiner

*Primary Examiner* — Brian D Mattei
(74) *Attorney, Agent, or Firm* — Oliff PLC

(57) ABSTRACT

A system and method for attaching a deck to a structure. The system includes at least one attachment plate provided with at least one fastening component. The fastening component extends into the at least one I-joist attachment piece attached to an I-shaped structure floor joist. A connecting component extends from the at least one attachment plate to the deck ledger.

11 Claims, 3 Drawing Sheets

APPARATUS AND METHOD FOR ATTACHING DECK TO STRUCTURE

BACKGROUND

Requirements for attaching a deck to a structure, such as a house, include having the attachment comply with the international residential code (IRC). The IRC requires a deck-to-house connection that is capable of withstanding a particular lateral and tension load, such as 1500 pounds.

To achieve the appropriate tension connection for such a load, some methods involve screwing metal connectors onto each side of the connection, e.g., one connector attached to the side of a deck joist and a corresponding connector attached to the side of a house joist. In such a method, a ½" diameter threaded rod is generally threaded through each of the two paired metal connectors in order to connect the side of the deck joist to the side of the house joist (house floor joist) to ensure an adequate tension connection. This method requires the person installing the deck to have access to the interior of the house in order to install the steel connector onto the side of the house joist. Further, such a connection would require the installer to drill a hole into the house band board in order to pass the rod through the house band board so as to connect the steel connector to the deck joist.

In some other known attachment configurations, an attachment bracket of a deck ledger (deck rim joist) may be mounted to a concrete foundation of a house, as described in U.S. Pat. No. 6,397,552, which is incorporated herein by reference in its entirety.

In these configurations, the installer is generally required access to the house. In many practical situations, installer access to the house is difficult or undesirable, and can create inefficiencies in the construction process. Further, the installer may have to remove and later fix drywall on the house interior in order to make the house connection, which involves further inefficiencies.

Additionally, the orientation of the threaded rod or other connecting component in some of the related art configurations will create a thermal bridge between the exterior and interior of the house. This thermal bridge, especially in areas prone to significant temperature fluctuations, can create condensation on the steel connector and the threaded rod. This can lead to wood deterioration and/or formation of mold.

A system and method for attaching a deck to a structure is disclosed in U.S. patent application Ser. No. 14/270,090, which is herein incorporated by reference in its entirety. Such a system includes at least one attachment plate provided with at least one fastening component. The fastening component is fastened to the structure ledger and extends into the end face of the floor joist of the structure.

SUMMARY

The instant application seeks to remedy some or all of the deficiencies for known connections of a deck to a structure. This summary is provided to introduce a selection of concepts that are further described below in the detailed description. This summary is not intended to identify key or essential features of the claimed subject matter, nor is it intended to be used as an aid in limiting the scope of the claimed subject matter. The statements made merely provide information relating to the present disclosure, and may describe some embodiments illustrating the subject matter of this application.

In an aspect, a deck attachment system for attaching a deck having a deck joist and a deck ledger to a structure having an I-shaped floor joist and a structure ledger is disclosed. The system includes at least one attachment plate with one or more fastener holes, at least one fastening component oriented so as to be capable of attaching the at least one attachment plate to at least one of the deck ledger and the structure ledger, and at least one connecting component capable of connecting the attachment plate to at least a portion of the deck joist. Attached to the I-shaped floor joist of the structure is at least one I-joist attachment piece. The at least one fastening component is configured to be fastened into a face of the at least one I-joist attachment piece attached to the I-shaped floor joist of the structure.

In another aspect, a deck attachment system for attaching a deck having a deck joist and a deck ledger to a structure having an I-shaped floor joist and a structure ledger is disclosed. The system includes at least one attachment plate with one or more fastener holes, at least one fastening component oriented so as to be capable of attaching the at least one attachment plate to at least one of the deck ledger and the structure ledger, and at least one connecting component capable of connecting the attachment plate to at least a portion of the deck joist. Attached to the I-shaped floor joist of the structure is at least one I-joist attachment piece. The at least one fastening component is configured to be fastened into an end grain of the at least one I-joist attachment piece attached to the I-shaped floor joist of the structure.

DETAILED DESCRIPTION

Figure 1:
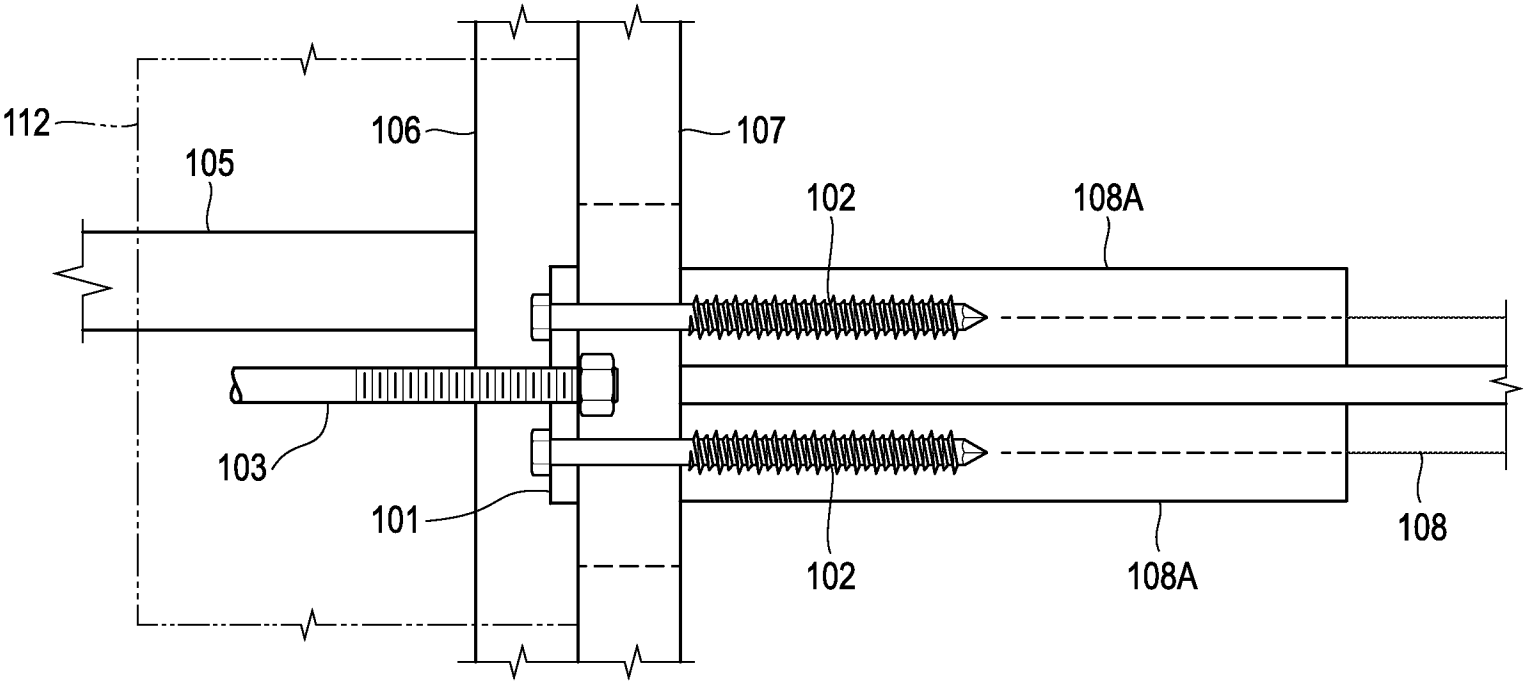
FIG. 1 shows a deck attachment system according to an embodiment.

In the following description, numerous details are set forth to provide an understanding of the present disclosure. However, it may be understood by those skilled in the art that the methods of the present disclosure may be practiced without these details and that numerous variations or modifications from the described embodiments may be possible.

At the outset, it should be noted that in the development of any such actual embodiment, numerous implementation—specific decisions may be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the device and method described herein can also comprise some components other than those cited. In the summary and this detailed description, each numerical value should be read once as modified by the term "about" (unless already expressly so modified), and then read again as not so modified unless otherwise indicated in context. The term about should be understood as any amount or range within 10% of the recited amount or range (for example, a range from about 1 to about 10 encompasses a range from 0.9 to 11). Also, in the summary and this detailed description, it should be understood that a range listed or described as being useful, suitable, or the like, is intended to include support for any conceivable sub-range within the range at least because every point within the range, including the end points, is to be considered as having been stated. For example, "a range of from 1 to 10" is to be read as indicating each possible number along the continuum between about 1 and about 10. Furthermore, the subject matter of this application illustratively disclosed herein suitably may be practiced in the absence of any element(s) that are not specifically disclosed herein.

The following definitions are provided in order to aid those skilled in the art in understanding the detailed description.

As used herein, the term "fastening component" refers to any component capable of securing one member to another, such as glue or other adhesives, screws and nails.

As used herein, the term "connecting component" refers to a structure capable of performing a direct or indirect connection from one member to another. In some embodiments, a connecting component may be a threaded rod made of metal, but one skilled in the art would also understand that any component capable of causing a connection between two members, such as a wooden rod, a block, a plate or portion of a plate with screws, a chain or the like, can also be considered a connecting component as it applies to this disclosure. A connecting component as particularly used herein may connect, directly or indirectly, a deck to a structure, further accommodating the appropriate weight and tension transfer between the deck and structure, so as to comply with the appropriate building codes.

The term "structure" as used in this application refers to an anchored structure capable of having a deck connected to it. The structure may be a house, a commercial building, an apartment, or any anchored structure. The structure may or may not be subject to IRC residential codes.

The term "deck" as used herein refers to any formation that is capable of being attached or otherwise connected to a structure. Though the deck as referred to herein generally refers to an exterior deck (e.g., to be constructed on an outside of the structure), one skilled in the art would appreciate that a deck may also be attached, at least in part, to an interior portion of the structure. One skilled in the art would recognize that the deck may be made of suitable wood, but also of any other suitable material, such as plastic or metal.

The term "I-shaped," for example as it refers to I-shaped floor joist, refers to a beam or the like that has an I-shaped cross-section. The vertical element of the I-shaped beam is referred to herein as a "web." I-shaped floor joist as used herein is synonymous with an I-shaped house joist, and to materials referred to in the trade as "I-beams" or "I-joists."

Figure 2:
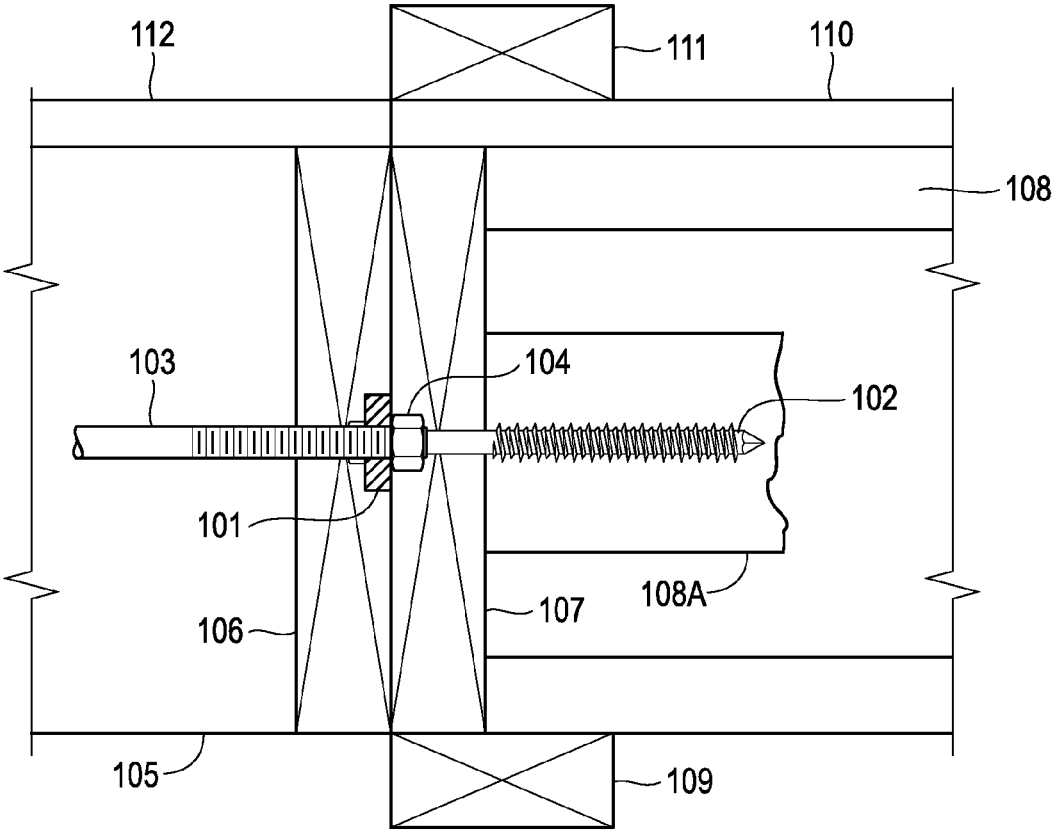
FIG. 2 shows a side view of a deck attachment system according to an embodiment
Figure 3:
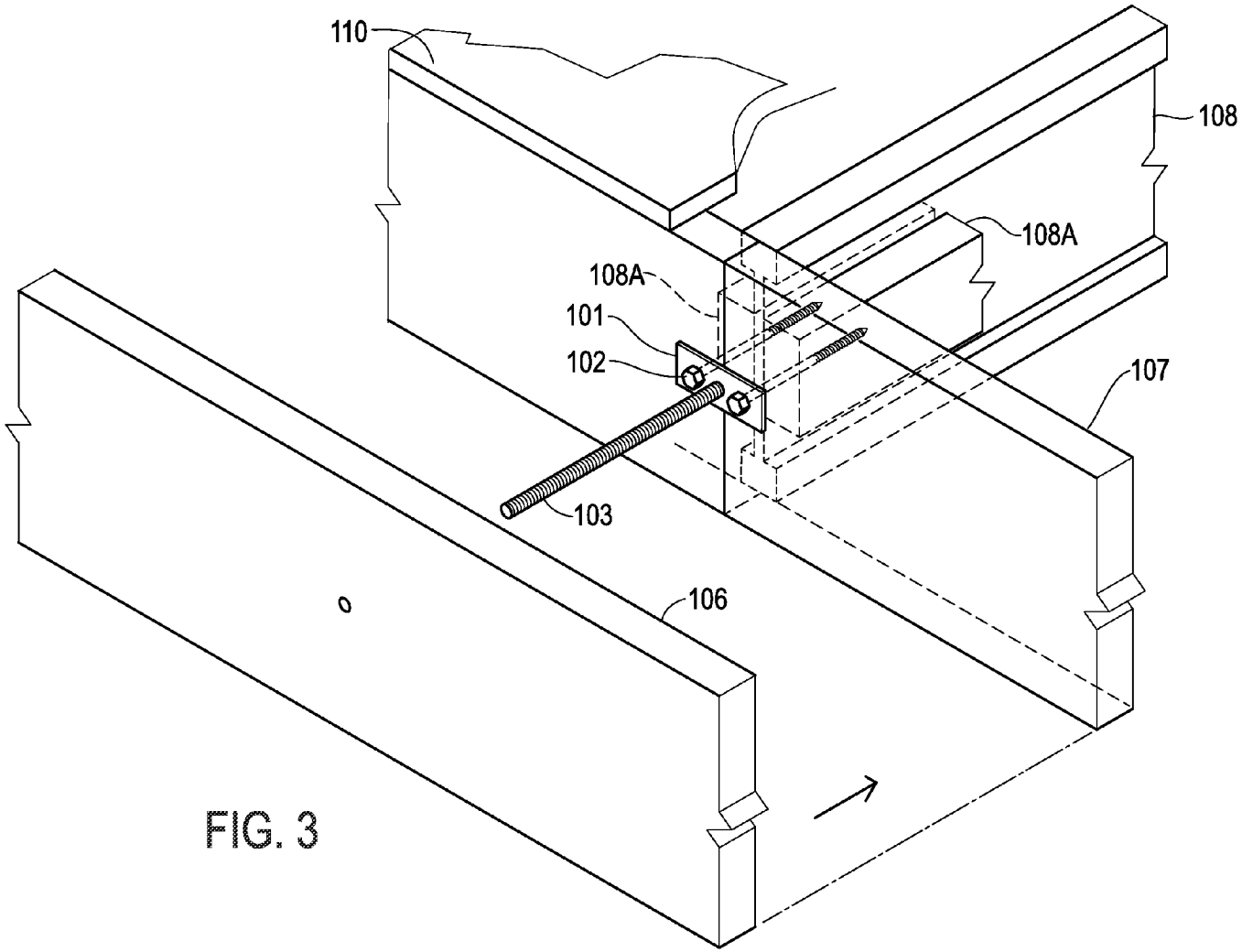
FIG. 3 shows an isometric view of a deck attachment system according to the embodiment.

Referring to FIGS. 1-3, an embodiment describing a system for attaching a deck to a structure is shown. The attachment may be for a connection that is capable of withstanding a lateral and tension load, as opposed to a gravity load. The structure may be a house. The deck attachment system may be provided at a location under the decking 112 and structure sub-floor 110. The house structure may include a house sill plate 109, which is a sill plate on top of a foundation wall of the house, and a house wall sill plate 111. The house wall sill plate may be at a bottom of the framed house wall.

The deck attachment system includes an attachment plate 101. The attachment plate 101 may be provided on one or more I-joist attachment pieces 108A attached to an I-shaped floor joist 108 of the house.

In other embodiments not shown, the attachment plate may alternatively be provided on an outside longitudinal face of the house ledger (rim joist) 107 (not shown), or the deck ledger 106. In such embodiments, the attachment plate may attach to its respective component by any suitable means, including but not limited to method described in U.S. patent application Ser. No. 14/270,090, which has been incorporated by reference in its entirety. The instant description relates to the attachment system shown in FIGS. 1 and 2, which includes a single attachment plate attached to the one or more I-joist attachment pieces 108A. However, the instant description is not limited to such a description, and can be extended to include multiple attachment plates such as those as described in U.S. patent Ser. No. 14/270,090. In some variations, multiple attachment plates (not shown) can be used, with one attachment plate provided on an outer face of the deck ledger, and another provided on a longitudinal face of the house ledger or one or more I-joist attachment pieces.

The attachment plate 101 may be formed from a single material, such as sheet metal. In some embodiments, the material will be selected based upon stress/strain characteristics and having a length, width and thickness sufficient to ensure that the deck-house connection is capable of withstanding a lateral load required by the IRC.

The attachment plate 101 may have a length of about 3 to about 14 inches, and a width from about 1 to about 4 inches. Further, the attachment plate may have a length of about 3.5 inches and a width of about 1.5 inches. The attachment plate may be oriented in such a direction whereby its length extends along a longitudinal face of the deck ledger and/or the structure ledger.

The attachment plate 101 may be substantially rectangular in shape, or may be of any shape so as to allow for proper and acceptable weight transfer. The thickness of the attachment plate may be designed in relation to the necessary weight bearing and tension requirements for the connection to be performed. The attachment plate 101 may have a thickness of about 3/16 inches to about ¾ inches. Further, the attachment plate 101 may have a thickness of about ¼ inches.

In addition to sheet metal, any material found capable of providing the proper tension connection may be used, such as molded plastics, composites, and castable materials such as other metals.

The attachment plate 101 may be provided with one or more connecting holes for connecting the attachment plate with the deck joist 105. In some embodiments, through the one or more connecting holes, a connecting component 103 may be placed through the metal plate and through a hole 113 of the deck ledger (deck rim joist) 106. The attachment plate 101 may be connected, directly or indirectly, to the house ledger (house rim joist) 107. The connecting component may be anchored by means of a nut 104 disposed on the end of the connecting component at the inner face of the deck ledger 106. The connecting component may or may not extend into the house ledger 107. The connecting component may be a threaded rod, or any other component capable of properly connecting the attachment plate to the deck joist. In embodiments where a threaded rod is used, the threaded rod may be threaded through the hole 113 in the deck ledger, and reach the deck joist 105. The threaded rod 103 may be connected to the deck joist 105 by means of traditional connections known to one skilled in the art, such as by brackets. The hole 113 may be drilled by a standard drill, such as a power drill or a hand drill.

The attachment plate 101 may also be provided with one or more attachment holes to enable fastening of the attachment plate to the house. The attachment holes may be pre-drilled into the attachment plate, or may be created during the attachment process. In some embodiments, fastening components such as screws 102 are utilized to fasten the attachment plate to the house ledger 107. Further, in some embodiments, screws 102 fasten the attachment plate directly to one or more I-joist attachment pieces 108A that are connected to a portion of the floor joist 108. In such embodiments, the house ledger 107 may have a portion removed and/or hollowed out (e.g., cut out) to enable more efficient connection of the threaded rod 103 from the attachment plate 101 to the deck ledger 106 and ultimately to the deck joist 105. In some embodiments, the cut out portion of the house ledger is at least 4.5 inches in width and at least 4 inches in height.

In some embodiments, the floor joist is an I-shaped floor joist. The one or more I-joist attachment pieces 108A may be attached to the I-shaped floor joist by any suitable fastening means, such as screws, nails, glue or other adhesives. The one or more I-joist attachment pieces may be attached to the web of the I-shaped floor joist, i.e., to one or both sides of the web, which may be at a point where an end face of the I-shaped floor joist abuts the house ledger. In some embodiments, an I-joist attachment piece is provided on each side of the I-shaped floor joist, with one I-joist attachment piece extending radially away from the I-shaped floor joist and the other I-joist attachment piece extending radially away from the I-shaped floor joist in an opposite direction. In some embodiments, the I-joist attachment pieces 108A are perpendicular to the web of the I-shaped floor joist. Further, the I-shaped attachment pieces 108A may be placed at an orientation flush with a portion of the house ledger 107, such as with an interior portion or an exterior portion of the house ledger 107. Such an orientation may be at or near the cut out portion of the house ledger 107.

The one or more I-joist attachment pieces may further be connected, either directly or indirectly, to the back face of the house ledger 107. Further, the attachment plate may be parallel to the one or more Hoist attachment pieces, so as to allow for screws to extend from the attachment plate to the I-joist attachment pieces. The I-joist attachment pieces may be of any suitable shape, provided that the I-joist attachment pieces and associated connections can withstand the necessary load requirements. The I-joist attachment pieces may take any suitable shape, and may be, for example, a block that is a rectangular prism in nature, or triangular, spherical. The Hoist attachment pieces may even be amorphous in nature. The I-joist attachment pieces may be of any suitable material, such as wood, provided that the I-joist attachment pieces and associated connections can withstand the necessary load requirements.

In some embodiments, one or more screws 102 are fastened into an end grain of the one or more I-joist attachment pieces 108A. The screws may alternatively be fastened to any portion of the I-joist attachment pieces 108A, such as the side grain of the I-joist attachment pieces, provided that the connection can withstand the necessary load requirements. While two screws have been found to allow for proper fastening and accommodates the required weight distribution, one skilled in the art would understand that the number of screws that can be used is not limited to two, and may in fact be one, or three, or four or more, provided that the attachment satisfies weight bearing and/or tension requirements of applicable building codes. It would also be understood to one skilled in the art that the attachment plate 101 can be fastened to the one or more I-joist attachment pieces 108A by means other than screws, thereby using zero screws, provided that the building codes are still satisfied. Further, the attachment plate may alternatively or additionally be fixed, with or without screws, directly to the I-shaped floor joist 108.

Further, though only one attachment plate 101 is shown, one skilled in the art would recognize that a plurality of attachment plates can be used, each being secured to appropriate locations on and along the length of the house ledger, provided that the attachment plates in sum accommodate the required weight bearing requirements under applicable building codes. For example, some embodiments may use only two attachment plates, one at either end of the length of the house ledger. Additional attachment plates may also be located between the length ends of the house ledger, if desired or required.

The screws 102 may be lag screws, and may have a lag length of about 2 inches to about 8 inches, or about 2 inches to about 6 inches. The screws may have a screw diameter of about ¼ inches to about ⅜ inches, or about 5/16 inches. The screws may be screwed a distance into the end face of the one or more I-joist attachment pieces 108A, so as to ensure adequate attachment and proper weight transfer in accordance with IRC standards or any other applicable standards. To achieve this, the attachment plate should be lined up with the I-joist attachment pieces 108A such that the attachment holes are aligned with a face such as the end face of the I-joist attachment pieces, and thus the screws may be readily inserted into the I-joist attachment pieces. In some embodiments, the lag screws are screwed at least 2 inches into the end face of the one or more I-joist attachment pieces 108A, as measured from the screw insertion point at the base of the house joist to the last thread of the screw before the point of the screw. The lag screws may also be screwed about 2 inches to about 4.5 inches into the end face of the house joist, or about 2.5 inches. The screws 102 may be in direct withdraw, and thus are capable of being pulled straight out without any of twisting or rotation of the screws. Thus, the screws 102 do not have to be laterally loaded, though one skilled in the art would appreciate that the screws 102 are capable of being laterally loaded. To allow for the appropriate connections of the deck to the house to be made given the inclusion of the screws and attachment plates and the like, a channel 114 may be cut into the deck ledger 106 to accommodate for the additional components while still allowing the deck ledger 106 and house ledger 107 to ultimately remain in a flush arrangement.

Owing to the configuration described above, a lateral load can be applied to the connecting component 103, via a traditional connection of the deck joist 105 and the connecting component 103 known to one skilled in the art. The load can then be transferred to the attachment plate 101, for example by means of the nut 104 on the end of the connecting component 103. The load at the attachment plate 101 can then be transferred to the one or more screws 102, which are screwed through the house ledger 107 and I-joist attachment pieces 108A that are attached to the web of I-shaped floor joist 108. Thus, the lateral load is ultimately transferred to the I-shaped floor joist 108.

The material and sizes of the attachment plate 101, as well as the screws 102 are selected so as to ensure satisfaction of building codes. The attachment plates may be provided in dimensions suitable to accommodate the appropriate tension and bear the appropriate weight under building codes and may be of similar dimensions as those described in the first embodiment.

In this embodiment, when a lateral load is applied to connecting component 103, the load may be transferred to the attachment plate 101 by means of a nut 104 on an end of the connecting component 103. The attachment plate 101 load is then transferred to the screws 102, which are screwed through the deck ledger 106, into the house ledger 107. This transfers the load to the house ledger 107. The load on the house ledger 107 can then be transferred through to the one or more I-joist attachment pieces 108A which are attached to the house I-joist 108.

Owing to the configurations in one or more of the embodiments above, a contractor or installer will advantageously be able to install the deck to the structure in an efficient, simplified manner, and may be able to avoid any entry into the structure itself. Further, the configurations in one or more of the embodiments may allow for a reduction in mold or other disadvantegous buildup of fluid or the like at connection points between the deck and the structure.

While the above embodiments reference a deck connection to a house, it will be appreciated that such a connection may be applicable for attaching a deck to any structure, such as a commercial building. Further, the connection may also be applicable for attaching any external component to a structure or building, and thus is not limited to attaching a deck, as described herein. While the embodiments particularly refer to screws as an exemplary fastening component, one skilled in the art would understand that any fastening component under the definitions provided herein may be suitable. Additionally, while the embodiments particularly refer to a threaded rod as an exemplary connecting component, one skilled in the art would understand that any connecting component under the definitions provided herein may be suitable for use.

The above FIGS. 1-2 show systems that allow for one connection of a deck ledger to a house ledger. Additionally, in connecting a deck to a house, the systems shown in FIGS. 1-2 can be provided in concert with, or in addition to, other connections based upon traditional methods, provided the connections comply with the applicable weight-bearing requirements under the applicable codes. Further, one skilled in the art would appreciate that each of the embodiments described above are not mutually exclusive. At different attachment points throughout a house-deck connection, different embodiments may be used. One skilled in the art would recognize that the attachment system provided herein may be used in other applications requiring particular weight bearing attachment.

Further, although the preceding description has been described herein with reference to particular means, materials and embodiments, it is not intended to be limited to the particulars disclosed herein; rather, it extends to all functionally equivalent structures, methods and uses, such are within the scope of the appended claims.

What is claimed is:

1. A deck attachment system for attaching a deck to a structure having a structure ledger, comprising:

at least one flat metal attachment plate with one or more fastener holes;

a deck joist;

an I-shaped floor joist having at least one I-joist attachment piece attached to the I-shaped floor joist;

at least one fastening component oriented so as to be capable of attaching the at least one flat metal attachment plate to at least one of a deck ledger, the structure ledger, the I-shaped floor joist and the at least one I-joist attachment piece;

at least one connecting component that connects the at least one flat metal attachment plate to at least a portion of the deck joist, wherein the at least one fastening component is fastened directly into the at least one I-joist attachment piece.

2. The deck attachment system according to claim 1, wherein the at least one flat metal attachment plate is directly attached to the at least one I-joist attachment piece.

3. The deck attachment system according to claim 1, further comprising at least two I-joist attachment pieces.

4. The deck attachment system according to claim 3, further comprising at least two fastening components, with each of the at least two of the fastening components extending into a respective I-joist attachment piece.

5. The deck attachment system according to claim 1, wherein the at least one fastening component is fastened directly into an end grain of the at least one I-joist attachment piece.

6. The deck attachment system according to claim 1, wherein the at least one I-joist attachment piece is parallel to the at least one flat metal attachment plate.

7. The deck attachment system according to claim 1, wherein the at least one flat metal attachment plate is a rectangular plate having a length that extends along a longitudinal direction of the deck ledger.

8. The deck attachment system according to claim 1, wherein the at least one I-joist attachment piece is attached to the I-shaped floor joist at a web of the I-shaped floor joist.

9. The deck attachment system according to claim 1, wherein the connecting component is a threaded rod.

10. A deck attachment system for attaching a deck having a deck joist and a deck ledger to a structure having a structure ledger, comprising:

a deck joist;

at least one flat metal attachment plate with one or more fastener holes;

an I-shaped floor joist having at least one I-joist attachment piece attached to the I-shaped floor joist;

at least one fastening component oriented so as to be capable of attaching the at least one flat metal attachment plate to at least one of the deck ledger, the structure ledger, the I-shaped floor joist and the at least one I-joist attachment piece;

at least one connecting component that connects the at least one flat metal attachment plate to at least a portion of the deck joist;

wherein the at least one fastening component is fastened directly into an end grain of the at least one I-joist attachment piece.

11. The deck attachment system according to claim 10, wherein the structure ledger includes a hollowed out portion.

* * * * *